US008807503B2

(12) United States Patent
Zavala, Jr.

(10) Patent No.: US 8,807,503 B2
(45) Date of Patent: Aug. 19, 2014

(54) TABLECLOTH RETAINER

(71) Applicant: Jose Alberto Zavala, Jr., Gonzales, CA (US)

(72) Inventor: Jose Alberto Zavala, Jr., Gonzales, CA (US)

( * ) Notice: Subject to any disclaimer, the term of this patent is extended or adjusted under 35 U.S.C. 154(b) by 0 days.

(21) Appl. No.: 13/895,732

(22) Filed: May 16, 2013

(65) Prior Publication Data

US 2013/0305496 A1 Nov. 21, 2013

Related U.S. Application Data

(60) Provisional application No. 61/648,835, filed on May 18, 2012.

(51) Int. Cl.

| | |
|---|---|
| ***A47G 1/17*** | (2006.01) |
| ***B65D 65/02*** | (2006.01) |
| ***A47C 31/00*** | (2006.01) |
| ***E04B 1/34*** | (2006.01) |

(52) U.S. Cl.
USPC ..... 248/309.4; 248/206.5; 150/154; 150/158; 108/90; 297/219.1; 52/3; 52/4

(58) Field of Classification Search
USPC ..... 248/309.4, 206.5; 150/154, 158; 108/90; 297/219.1; D6/610, 612; 52/3, 52/4
See application file for complete search history.

(56) References Cited

U.S. PATENT DOCUMENTS

| | | | | |
|---|---|---|---|---|
| 3,629,905 | A * | 12/1971 | Cote | 24/30.5 R |
| 5,060,712 | A * | 10/1991 | Ehrlich | 160/330 |
| 5,084,321 | A | 1/1992 | Sui | |
| 5,682,653 | A * | 11/1997 | Berglof et al. | 24/303 |
| 6,457,423 | B1 * | 10/2002 | Gordon | 108/90 |
| 7,377,515 | B2 | 5/2008 | Barker | |
| 7,905,039 | B2 * | 3/2011 | Karovic | 40/320 |
| 8,209,890 | B2 * | 7/2012 | Beyer, Jr. | 40/107 |
| 2003/0015270 | A1 * | 1/2003 | McClenahan et al. | 150/158 |
| 2007/0051285 | A1 * | 3/2007 | French et al. | 108/90 |
| 2007/0167106 | A1 * | 7/2007 | Hoover | 446/26 |
| 2010/0072794 | A1 * | 3/2010 | Karovic | 297/188.2 |
| 2010/0221467 | A1 | 9/2010 | Varga | |
| 2010/0224104 | A1 * | 9/2010 | Swistun | 108/90 |
| 2010/0275419 | A1 * | 11/2010 | Millus | 24/306 |
| 2011/0017104 | A1 | 1/2011 | Ditrolio | |

* cited by examiner

*Primary Examiner* — Terrell McKinnon
*Assistant Examiner* — Christopher Garft
(74) *Attorney, Agent, or Firm* — Donald R. Boys; Central Coast Patent Agency Inc.

(57) ABSTRACT

A tablecloth retainer includes an elastic band having at least a primary thickness, a width, and a predesigned boundary, wherein the elastic band is stretched around the perimeter edge of a table top to retain a tablecloth, the predesigned boundary being smaller than a range of table top perimeters accommodating the band by virtue of elasticity of the band.

3 Claims, 5 Drawing Sheets

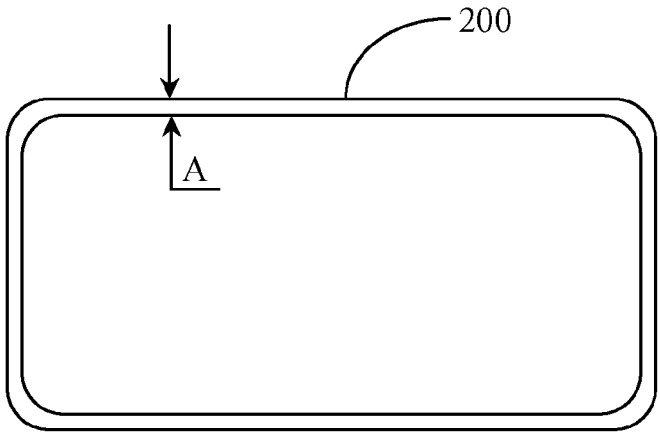
*Fig. 4*
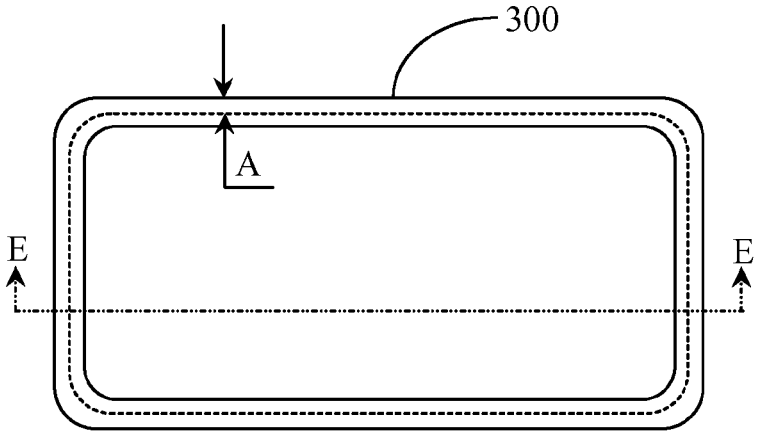
*Fig. 5*
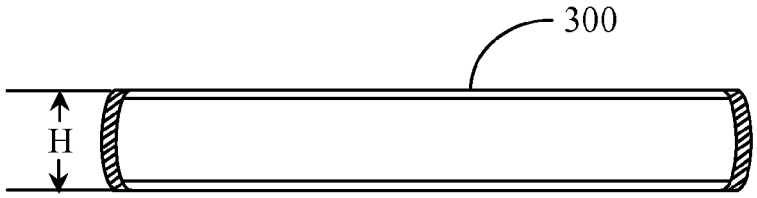
*Fig. 6 (Section EE)*

TABLECLOTH RETAINER

CROSS-REFERENCE TO RELATED DOCUMENTS

The present application claims priority to Provisional Patent Application 61/648,835 filed on May 18, 2012. The entire disclosure of that application is incorporated herein in its entirety at least by reference.

BACKGROUND OF THE INVENTION

1. Field of the Invention

The present invention is in the field of consumer products and pertains particularly to methods and apparatus for securing a tablecloth about a table.

2. Discussion of the State of the Art

In the field of consumer products, manufacturers are continually introducing new product types for aiding consumers with various tasks or with common problems that consumers deal with on a fairly consistent basis. One such common problem involves the aspects of securing a tablecloth or similar covering over a table subject to wind or other circumstances that might disturb the tablecloth. For example, persons who set up tables outdoors for various events typically have a range of options for securing a tablecloth over a table. A tablecloth may be weighted down on the table, in part by the items placed on the tablecloth and in part by placing weights at the corners of the table, for example. Other common methods for securing a tablecloth over a table include tacking or taping the tablecloth to the table.

What is clearly needed is a simple method and apparatus for securing a tablecloth placed over a table such that it does not blow off or become disarrayed on the table top due to wind conditions or any other disturbing circumstance.

SUMMARY OF THE INVENTION

A tablecloth retainer is provided and includes an elastic band having at least a primary thickness, a width, and a predesigned boundary, wherein the elastic band is stretched around the perimeter edge of a table top to retain a tablecloth, the predesigned boundary being smaller than a range of table top perimeters accommodating the band by virtue of elasticity of the band.

In one embodiment of the invention, the tablecloth retainer is manufactured of rubber. In one embodiment, the predesigned boundary is annular and accommodates annular table tops. In another embodiment, the predesigned boundary is rectangular and accommodates rectangular table tops.

In one embodiment of the invention, the tablecloth retainer further includes at least one lip contiguously formed along an edge or edges of the band, the at least one lip curling over the top and or bottom edge of the table when the band is placed around the table. In a variation of this embodiment, the tablecloth retainer has a secondary thickness about the center region of the band, the secondary thickness smaller than the primary thickness.

In another embodiment of the invention, the tablecloth retainer further includes two or more permanent magnets embedded therein or otherwise attached thereon, and two or more magnetic retainers, wherein the magnetic retainers are placed over the tablecloth against the magnets in the band securing the tablecloth there between.

In another embodiment of the invention, the tablecloth retainer further includes two or more light emitting diodes (LEDs), the LEDs embedded therein or otherwise attached thereon, and a controller having connection to power and a connection to the LEDs. In another embodiment, the tablecloth retainer further includes visual indicia in the form of art and or advertising rendered about a visible surface of the band.

In yet another embodiment the retainers have upper or lower extensions, or both, defining planar areas parallel to the tabletop above or below the tabletop.

BRIEF DESCRIPTION OF THE DRAWING FIGURES

FIG. 4 is a top view of a tablecloth retention band in an alternative geometric configuration.

FIG. 5 is a top view of a tablecloth retention band according to yet another embodiment of the invention.

FIG. 6 is a section view of the retention band of FIG. 5 taken along the section lines EE.

DETAILED DESCRIPTION

The inventor provides a tablecloth retainer, more particularly a tablecloth retention band that may be used to secure a tablecloth to a table in a manner that optimizes table space and prevents wind from lifting or otherwise displacing a tablecloth from a host table. The present invention is described in enabling detail using the following examples, which may describe more than one relevant embodiment falling within the scope of the present invention.

Figure 1:
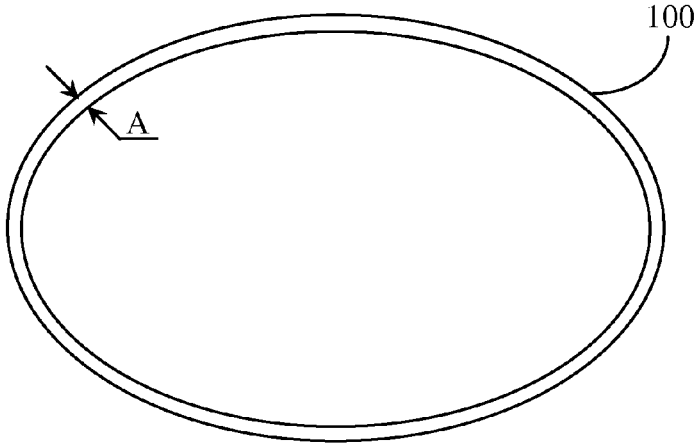
FIG. 1 is a top view of a tablecloth retention band according to an embodiment of the present invention.
Figure 2:
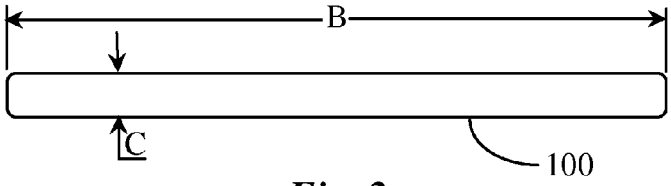
FIG. 2 is an elevation view of the retention band of FIG. 1.

FIG. 1 is a top view of a tablecloth retention band 100 according to an embodiment of the present invention. FIG. 2 is an elevation view of retention band 100 of FIG. 1. Referring now to FIG. 1, retention band 100 is, in this embodiment, a contiguous elastic band that has at least a primary thickness A. The exact primary thickness dimension of retention band 100 while at rest may vary according to application. In this embodiment thickness A is substantially uniform around the entire band.

Referring now to FIG. 2, band 100 has a width dimension C. Width dimension C may vary according to application, for example, bands of different widths might be provided for tables having different table top thickness dimensions. Retention band 100 includes a dimension B defining a major diameter of the band while at rest. In this embodiment, retention band 100 is of the shape of an ellipse, but might also be provided in a more circular shape. Retention band 100 may also be provided in custom configured shapes to fit specific shapes of table tops. For example, in some embodiments there may be four right angle corners in the band to fit a rectangular table.

Referring now back to FIG. 1, retention band 100 has a predesigned shape while at rest (not stretched) which is not affected by the action of stretching the band. In this basic embodiment, the shape is elliptical. The boundary perimeter or circumferential dimensioning of retention band 100 is a function of geometric shape of the band and measures generally twice the length of the band in an annular configuration. Retention band 100 is adapted for a range of table top perimeter sizes.

The length of band 100 at rest along with its elasticity governs the range of table top perimeter sizes over which the band may be stretched. While an elliptical or circular band may be applied to tables of different geometric shapes such as square, rectangular, hexagonal, triangular, etc. retention band 100 may also be provided to assume those specific geometric profiles while at rest without departing from the spirit and scope of the present invention.

Retention band 100 may be manufactured of natural or synthetic rubber or a mixture of the two, or may be made from synthetic polymer materials. Retention band 100 may be manufactured in varying grades of elasticity and may include varying surface textures. For example, a tablecloth retention band may have a high-friction surface on one or both sides of the band, or a smooth surface without departing from the spirit and scope of the present invention. In some embodiments, a gripping surface providing ample friction against a tablecloth is desired.

Figure 3:
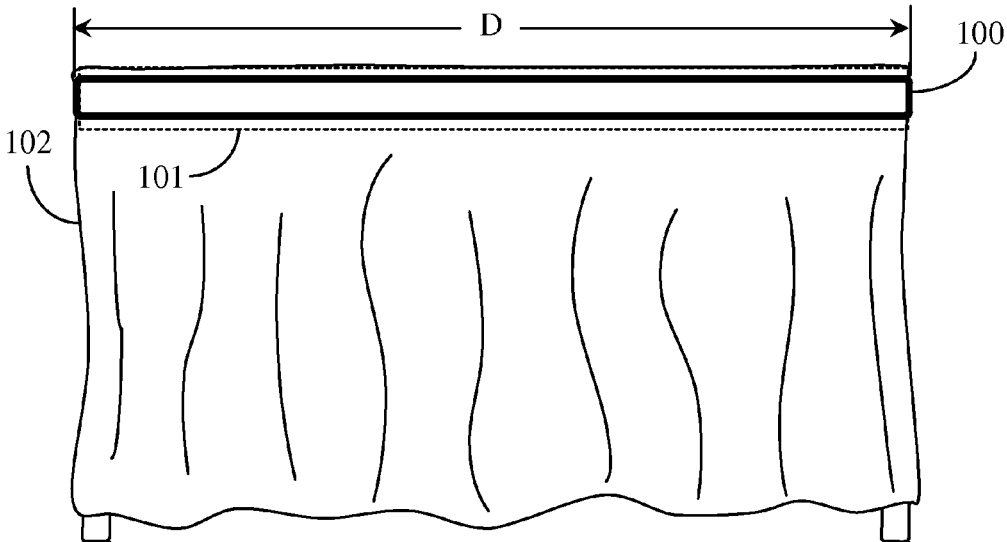
FIG. 3 is an elevation view of the retention band of FIG. 1 applied over a tablecloth on a table.

FIG. 3 is an elevation view of retention band 100 of FIG. 1 applied over a tablecloth on a table. Retention band 100 is, in this embodiment, stretched over the perimeter of a table 101 hosting a tablecloth 102. Dimension D represents a diameter of a circular table top or the major width of a table top in another geometric shape, such as rectangular. In this embodiment, retention band 100 is a straight band having a substantially uniform thickness A (FIG. 1) and a substantially uniform width C (FIG. 2).

In this application, the thickness of the top of table 101 is defined by a broken boundary. The width dimension of retention band 100 is smaller than the thickness dimension of the table top of table 101 in this particular example. In installation over the table top, the width dimension of the retention band may be positioned central to the thickness of the table top (centered on the perimeter). The force at which retention band 100 secures tablecloth 102 over table 101 is a function of the length of the band while at rest, dimensions of the table top, and the elasticity of the band. In one embodiment retention band 100 might be stretched around table 101 such that the edge of the band overlaps the top or bottom edge of the table top without departing from the spirit and scope of the invention.

FIG. 4 is a top view of a tablecloth retention band 200 in an alternative geometric configuration. Tablecloth retention band 200 includes a primary thickness A similar to retention band 100 in the annular configuration. Thickness dimension A may be substantially uniform across the band or it may vary somewhat without departing from the spirit and scope of the invention. However, in this embodiment, retention band 200 assumes the shape of a rectangle while at rest.

Retention band 200 may have the same or similar band width as width C (FIG. 2) or it may have a larger or smaller width dimension without departing from the spirit and scope of the present invention. Retention band 200 may be provided in various geometric forms and non-symmetrical custom shapes without departing from the spirit and scope of the present invention. In a typical manufacturing process, retention band 200 might be molded to assume any preconfigured shape that may be required to facilitate table top installation.

In this embodiment retention band 200 is particularly designed to fit a rectangular table of major and minor length dimensions that are larger than but directly proportional to the major and minor length dimensions of the retention band at rest.

FIG. 5 is a top view of a tablecloth retention band 300 according to yet another embodiment of the invention. FIG. 6 is a sectioned view of retention band 300 of FIG. 5 taken along the section line EE. Referring now to FIG. 5, retention band 300 is similar in geometric profile to retention band 200 (FIG. 2). Retention band 300 may also be provided in other geometric configurations including annular, hexagonal, and polygonal configurations without departing from the spirit and scope of the present invention.

Referring now to FIG. 6, in this embodiment, retention band 300 is formed in an accurate or C shape with respect to the body of the rubber band (shown here in crosshatching). In one embodiment, the accurate shape aids in the band's gripping ability when stretched around the perimeter surface of a table top. Referring back to FIG. 5, primary thickness A is substantially uniform across retention band 300. The accurate body shape of the band provides for a pronounced inward curl of the retention band when stretched over a table top hosting a tablecloth.

Referring again to FIG. 6, the width dimension H of retention band 300 while at rest may be the same or slightly larger than the thickness of a table top. In this case, the edges of retention band 300 naturally migrate inward when the band is stretched over a table top. In this embodiment, the inward protruding edges may function to effectively grip the edges of the table top over the tablecloth to prevent the retention band from accidentally being displaced vertically up or down once installed.

The accurate profile of the body of retention band 300, best seen in this sectioned view, may be provided regardless of the geometric configuration of the retention band. The rectangular configuration of retention band 300, best seen in FIG. 5, is intended as exemplary only as band 300 may be provided in any geometric or custom shape.

In one embodiment, retention band 300 includes a secondary thickness about the center region of the band relative to dimension H wherein the second thickness is smaller than the primary thickness. The center region of the band includes any area of the band body between the edges to varying degrees. For example, if H=1.00 inches, then the center region hosting the secondary thickness may be 0.75 inches in width leaving 0.18 inches of primary thickness along the edges of the band.

The secondary thickness about the center region of the band in this discussion enables an elevated amount of vertical stretch of the band body due to thinner material at the center, the thinner material providing greater vertical elasticity than the thicker primary thickness A. As a result of an added secondary thickness, a user may more easily stretch the band vertically to cover at least one or both edges of a table top thickness where the thickness dimension may be somewhat larger than width of retention band 300.

Figure 7:
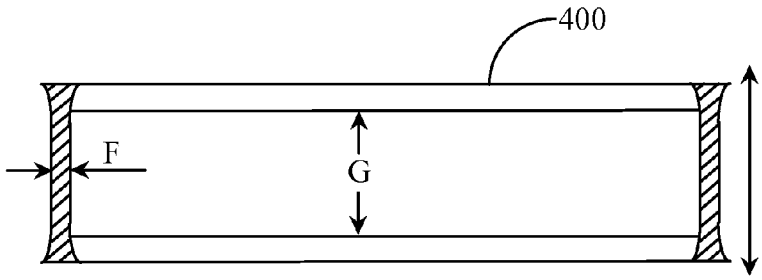
FIG. 7 is a general section view of a tablecloth retention band according to another embodiment of the present invention.
Figure 8:
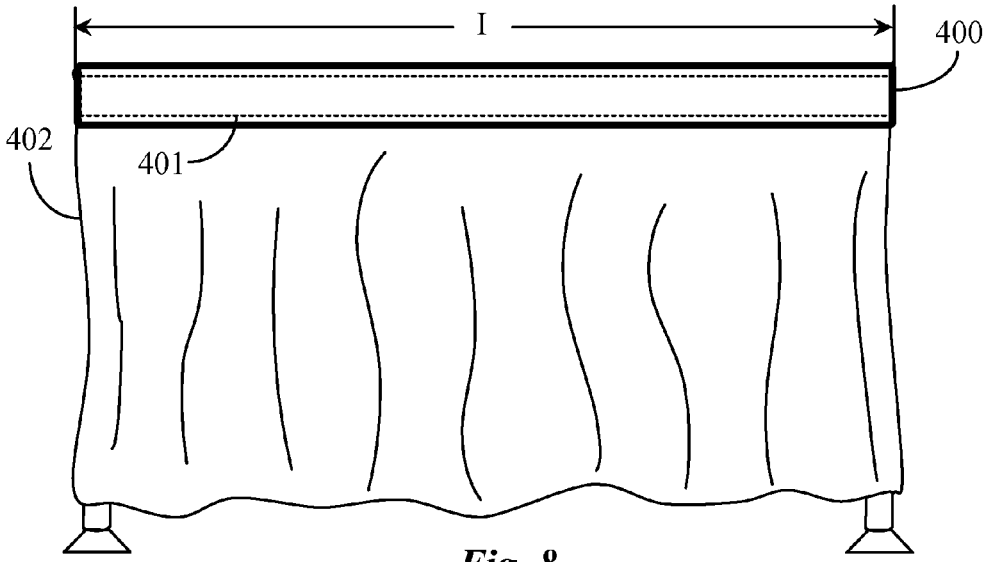
FIG. 8 is an elevation view of the retention band of FIG. 7 applied over a tablecloth on a table according to an embodiment of the present invention.

FIG. 7 is a general section view of a tablecloth retention band 400 according to another embodiment of the present invention. FIG. 8 is an elevation view of retention band 400 of FIG. 7 applied over a tablecloth on a table according to an embodiment of the present invention. Referring now to FIG.

7, tablecloth retention band 400 as seen in this sectioned elevation view includes a secondary thickness dimension F disposed about the center region of the band body along the entire boundary of the retention band. The region characterized as thinner than a primary thickness is defined herein by width dimension G.

In this embodiment, the edge regions of the band body defined by the areas outside of G are flared out to a primary thickness that is larger than the central secondary thickness F. Retention band 400 may be rectangular or annular, or of some other geometric shape without departing from the spirit and scope of the present invention. The geometric configuration of the retention band has no relevance to the profile of the band body (shown with crosshatching).

Referring now to FIG. 8, retention band 400 is stretched over a tablecloth 402 draped over a table characterized by table top 401 (broken boundary). Retention band 400 curls inward over the table top edges for a better grip on the table top perimeter by virtue of the flared edges of the band body best viewed in FIG. 7. An advantage of the flared profile of the band body in retention band 400 is that it will grab the edges of the table top regardless of which side of the band body interfaces with the table. In one embodiment of the invention, other edge configurations may be provided such as a rim or flanged edges, where the primary thickness of the body remains uniform accept for the edge features. There are many possible configurations.

Figure 9:
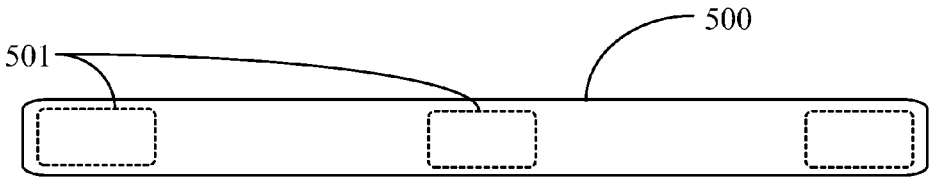
FIG. 9 is an elevation view of a tablecloth retention band according to still another embodiment of the invention.

FIG. 9 is an elevation view of a tablecloth retention band 500 according to still another embodiment of the invention. Retention band 500 may have an annular geometric profile or some other geometric profile as described further above relative to other embodiments already described. In this embodiment retention band 500 includes two or more permanent magnets that might be embedded or molded into the rubber-like material making up the band or that might be affixed to the non-interfacing side of the retention band body with adhesive. In one embodiment, permanent magnets 501 may be installed over the rubber body of retention band 500 such as by clamping onto the band body.

In this embodiment, permanent magnets 501 are adapted to magnetically attach to magnetic forms (not illustrated here) that may be used to retain a tablecloth in position over a table top hosting the retention band. In this application the band is joined to the table before the tablecloth is placed, and magnetic strips or pieces are used outside the tablecloth to attach magnetically through the cloth to the permanent magnets in the band.

Figure 10:
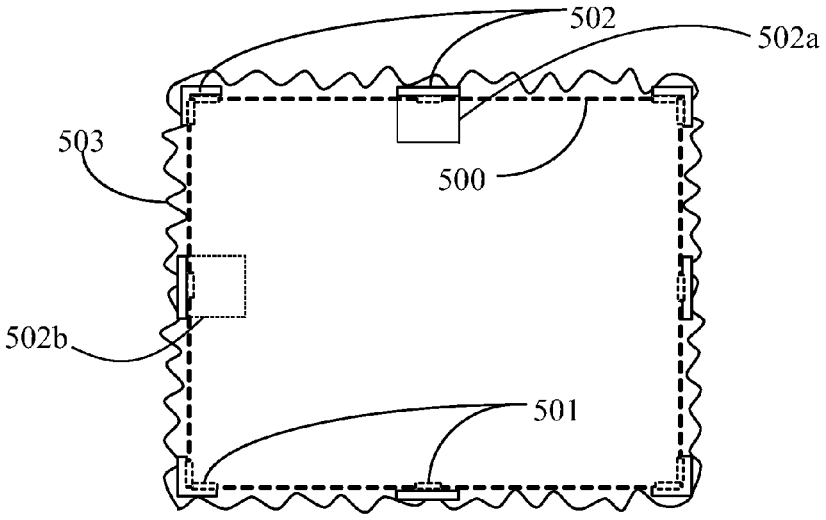
FIG. 10 is an overhead view of the retention band of FIG. 9 applied between a tablecloth and the peripheral surface of a table.

FIG. 10 is an overhead view of retention band 500 of FIG. 9 applied between a tablecloth 503 and the peripheral surface of a table. Retention band 500 is represented in this embodiment by a broken boundary around the table top perimeter. Magnets 501 are distributed about the perimeter of the retention band and are embedded within the band or affixed to the surface of the band that is not in contact with the table.

In this embodiment, tablecloth 503 is draped over the table and the retention band. Magnetic forms or components 502 are placed about the perimeter of the band at the locations of the embedded magnets. In this way, the magnets hold tablecloth 503 in place over the table whereas the retention band simply serves as a base for stationing the magnetic forms to hold the tablecloth against the retention band.

Figure 11:
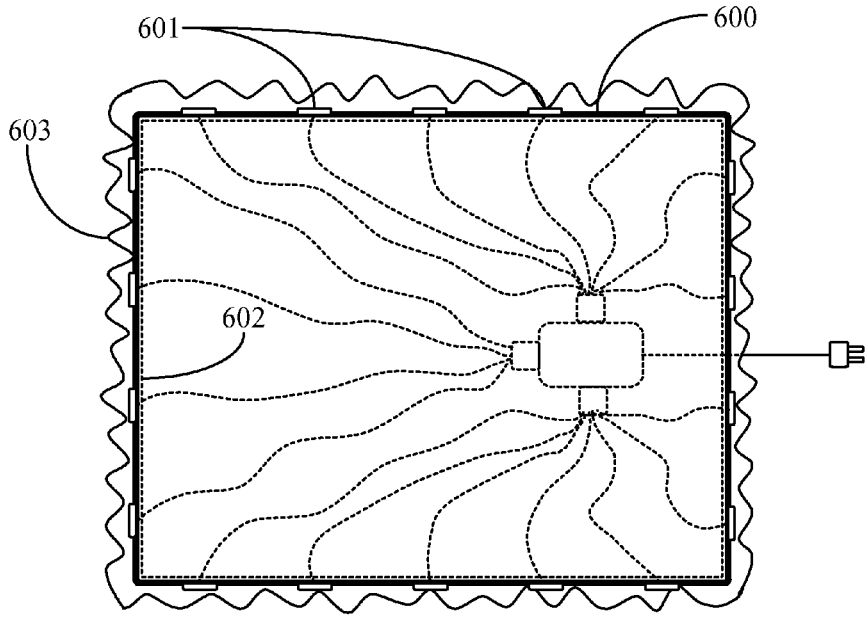
FIG. 11 is an overhead view of a tablecloth retention band applied over a tablecloth on a table, and integrated with an illumination system according to yet another embodiment of the present invention.

FIG. 11 is an overhead view of a tablecloth retention band applied over a tablecloth on a table, and integrated with an illumination system according to yet another embodiment of the present invention. A table top perimeter 602 is depicted with a broken boundary in this example. A tablecloth retention band 600 is provided and includes two or more light emitting diodes (LEDs) 601 distributed about the perimeter of retention band 600. LEDs 601 may be affixed to the outer surface of the retention band body by glue or another method of attachment.

In one embodiment, LEDs 601 are clamped over the retention band body of retention band 600. In still another application, the LEDs are embedded within the rubber material of the retention band. In this example, a controller 604 is provided for controlling the illumination of the LEDs. Controller 604 includes a plug 605 for plugging into a power source. Controller 604 may include individual leads that may be plugged into the LEDs to provide power to each LED after the band has been installed over a tablecloth and table.

Controller 604 may include a processor and a memory, the memory including instructions that cause the processor to distribute power to the LEDs to illuminate the tablecloth retention band. In one embodiment, controller 604 contains a programmable sequencer component that alternately distributes power to individual ones or groupings of the LEDs embedded in or otherwise installed on the retention band. The LEDs may be all the same color, all individual colors, or a mix of different colors.

Figure 12:
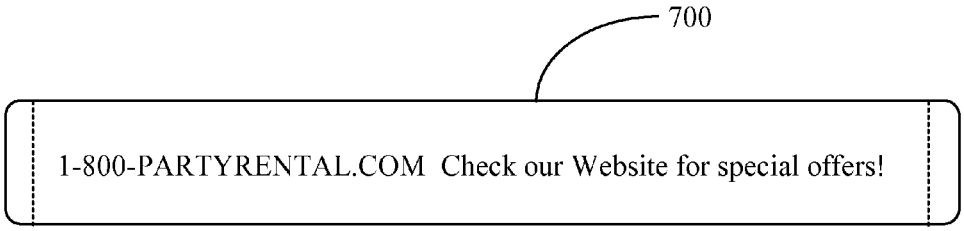
FIG. 12 is an elevation view of a tablecloth retention band in various embodiments supporting artistic design and or advertising space.

FIG. 12 is an elevation view of a tablecloth retention band 700 in various embodiments supporting artistic design and or advertising space. Retention band 700 in various embodiments may support artistic design and or advertisement media. In one embodiment, the outer side of band 700 visible when installed about a tablecloth on a table may support advertising text pre-printed on the band in a manner that provides legible advertising when the band is stretched over a table. In the same or a similar embodiment, band 700 may also support graphics design such as logos, pictures, etc. In one embodiment retention bands are custom designed for client events wherein the advertising or graphics design is related intimately to the event. For example, a wedding event may include a tablecloth retention band that supports pictures, text, and graphics relative to the bride and groom and family sitting at the same table. There are many possibilities.

In some further embodiments of the invention magnetic forms, magnetically permeable retainers or components 502, as shown, for example, in FIG. 10 may have other purposes. For example, magnets may be strategically placed in a flexible band, such that, when the band is applied to a table, the spacing will be a preferred spacing for adjacent personal spaces at the table. Such magnetically permeable retainers 502 may also be enabled so that names may be applied, to indicate where at the table persons are supposed to sit. In another alternative such magnetically permeable retainers 502 that attach magnetically to the magnets in the table band may have extensions above or below the table, or both. An extension 502*a* above the table, planar and lying flat on the table top, may provide place mats for persons to be seated at the table. An extension 502*b* under the table may provide for moving the tablecloth back at personal spaces, as an aid the seated persons, to hold the tablecloth away from the person's legs.

In an alternative embodiment of the invention flexible bands similar to the table bands may be provided for other purposes, for example to hold plastic liners in trash cans and barrels. In these embodiments printing may be placed on such bands, such as "cans", "bottles" and the like, to inform a user as to what items may be discarded in a trash container in use with a band according to an embodiment of the invention.

It will be apparent to one with skill in the art that the tablecloth retention band of the invention in various embodiments may be provided using some or all of the mentioned features and components without departing from the spirit and scope of the present invention. It will also be apparent to the skilled artisan that the embodiments described above are specific examples of a single broader invention which may have greater scope than any of the singular descriptions taught. There may be many alterations made in the descriptions without departing from the spirit and scope of the present invention.

What is claimed is:

1. A tablecloth retainer comprising:

an elastic band having at least a primary thickness, a width, and a predesigned shape;

two or more permanent magnets embedded therein or otherwise attached thereon; and two or more magnetically permeable retainers;

wherein the elastic band is stretched around the perimeter edge of a table top to retain a tablecloth, the predesigned boundary being smaller than a range of table top perimeters accommodating the band by virtue of elasticity of the band, and the tablecloth retainer is applied to the tabletop, the tablecloth is placed over the tabletop, and the magnetically permeable retainers are placed over the tablecloth against the magnets in the band securing the tablecloth therebetween.

2. The tablecloth retainer of claim 1 manufactured of natural or synthetic rubber, or an elastic polymer.

3. The tablecloth retainer of claim 1 wherein the magnetically permeable retainers have upper or lower extensions, or both, defining planar areas parallel to the tabletop above or below the tabletop.

* * * * *